United States Patent [19]

Sugino et al.

[11] 4,426,236

[45] * Jan. 17, 1984

[54] METHOD FOR MANUFACTURING HIGH STRENGTH RAIL OF EXCELLENT WELDABILITY

[75] Inventors: Kazuo Sugino; Hideaki Kageyama; Hiroki Masumoto, all of Kitakyushu, Japan

[73] Assignee: Nippon Steel Corporation, Japan

[ * ] Notice: The portion of the term of this patent subsequent to Mar. 8, 2000 has been disclaimed.

[21] Appl. No.: 340,335

[22] Filed: Jan. 18, 1982

Related U.S. Application Data

[60] Division of Ser. No. 202,195, Oct. 30, 1980, Pat. No. 4,375,995, which is a continuation-in-part of Ser. No. 37,146, May 8, 1979, abandoned.

[30] Foreign Application Priority Data

May 12, 1978 [JP] Japan ..... 53-56330

[51] Int. Cl.[3] ..... C22C 38/26

[52] U.S. Cl. ..... 148/36; 148/39

[58] Field of Search ..... 148/12 R, 12.4, 36, 148/39, 143, 144, 146, 152, 157; 75/123 R, 123 J, 126 D, 126 F

[56] References Cited

U.S. PATENT DOCUMENTS

| | | | |
|---|---|---|---|
| 2,882,191 | 4/1959 | Van Swaal | 148/152 |
| 3,519,497 | 7/1970 | Pomey | 148/134 |
| 3,622,407 | 11/1971 | Niculescu | 148/152 |
| 3,726,724 | 4/1973 | Davies et al. | 75/123 R |
| 3,846,183 | 11/1974 | Henry | 148/12 R |
| 3,846,184 | 11/1974 | Melloy et al. | 148/36 |
| 4,008,078 | 2/1977 | Flugge et al. | 75/123 J |
| 4,082,577 | 4/1978 | Heller | 148/39 |

FOREIGN PATENT DOCUMENTS

| | | | |
|---|---|---|---|
| 1583418 | 5/1972 | Fed. Rep. of Germany | 148/157 |
| 47-32168 | 8/1972 | Japan | 148/12.4 |
| 434965 | 9/1935 | United Kingdom | 148/12 R |
| 486044 | 5/1938 | United Kingdom | 148/12 R |
| 324292 | 6/1972 | U.S.S.R. | 148/36 |
| 582319 | 11/1977 | U.S.S.R. | 148/36 |

*Primary Examiner*—Peter K. Skiff

*Attorney, Agent, or Firm*—Wenderoth, Lind & Ponack

[57] ABSTRACT

A method for manufacturing high strength rail having excellent weldability comprises subjecting a steel rail of specific composition to specific heat treatment conditions at the surface layer portion of the head thereof, to impart high strength to the rail and to assure that the welded portion as well as the welded heat affected zone are free from deterioration caused by the welding process. The heat treatment conditions include a cooling rate which is substantially equivalent to that in a conventional welding process so as to impart high tensile strength to the treated portion of the rail.

5 Claims, 6 Drawing Figures

PRESENT INVENTIVE RAIL E
PRESENT INVENTIVE RAIL A
CONVENTIONAL RAIL C
CONVENTIONAL RAIL D
WIDTH OF HEAT AFFECTED ZONE

X400

X400

X5,000

X5,000

X20,700

METHOD FOR MANUFACTURING HIGH STRENGTH RAIL OF EXCELLENT WELDABILITY

CROSS-REFERENCE TO RELATED APPLICATION

This is a divisional of co-pending application Ser. No. 202,195, filed Oct. 30, 1980 now U.S. Pat. No. 4,375,995 which is a continuation-in-part of Ser. No. 37,146, filed May 8, 1979, now abandoned.

BACKGROUND OF THE INVENTION

1. Field of the Invention

The present invention relates to a method for manufacturing high strength rail of excellent weldability.

2. Description of Prior Art

Modern railroads have stringent requirements for rails, particularly in the areas of high speed transit as well as heavy load service. Problems in such areas include fractured running surfaces and abrasion at the sides of rail heads, thus creating a demand for high strength rails which are able to withstand severe service conditions.

Moreover, most rails in current production are of the long rail type, which rails are produced by welding standard size rails to each other. In these types of rails, it is desired to avoid fracture at the joint portions thereof as well as to decrease the labor cost for track maintenance. Therefore, good weldability and homogeneity in the quality of the rail at the weld are also required for said high strength rails.

However, techniques for production of high strength rails to date have not taken into account deterioration in quality of the rail caused by welding, that is, hardening, fragility or softening at the weld heat affected zone. Therefore, it is desirable to produce rails having improved weldability.

High strength rails to date are roughly classified into two categories, that is (1) as-rolled alloy steel rails and (2) heat treated carbon steel rails. One example of low alloyed heat treated rail is disclosed in Davies et al., U.S. Pat. No. 3,726,724. The rail steel disclosed in the above-mentioned patent is produced by adding to ordinary carbon steel for rails at least one hardening element such as Mn, Si, Cr, Ni and Mo in a total amount not more than 5%, at least one grain refining element such as Al, V, Nb, Ti and Zr and N in a stoichiometric proportion with respect to the amount of said grain refining ingredient already added. Subsequently said steel is formed into a rail by rolling, is normalized by reheating at above the $A_3$ transformation point and is air cooled in the next stage, or is subjected to finish rolling under controlled rolling conditions at a temperature ranging from 700° C. to 900° C. The resulting rail has a ferrite and pearlite structure shown in FIG. 2 containing fine ferrite grains which are finer than A.S.T.M. grain size No. 8.

The rail steel thus produced has a ferrite and pearlite structure as mentioned above. The tensile strength thereof is about 70 to 81 kg/mm$^2$ as disclosed in the specification, and is far less than the tensile strength of 120 kg/mm$^2$ or more which value is the objective of the present invention.

The aforesaid "normalizing" of steel involves a final heat treatment at the austenite temperature followed by cooling with air, where there is the possibility that when said rail steel is subjected to welding, the quality of the rail may be deteriorated in the weld heat affected zone as compared with the base material zone.

Moreover, conventional as-rolled alloy steel rails stronger than the foregoing rail steel of U.S. Pat. No. 3,726,724 can be obtained by other processes, e.g. adding alloy elements, such as Si, Mn, Cr, Mo, V and the like to an ordinary carbon steel rail, then hot rolling said steel into a rail followed by ambient cooling to induce pearlite transformation as shown in FIG. 3. Such steel rail has a tensile strength of 100 to 120 kg/mm$^2$, therefore, the foregoing process must employ a rather large quantity of alloy elements because of the fact that a high tensile strength is obtained at a rather slow cooling rate in the course of air cooling to form an austenite structure steel after rolling.

When the aforementioned rails are welded to each other to form an elongated rail, the cooling rate of the weld joint portion and the weld heat affected zone is somewhat faster than the cooling rate after hot rolling. Thereby martensite is grown locally which causes considerable hardening and embrittlement as compared with the base material rail, and is accompanied by serious problems in actual use such as, for instance, failure and uneven abrasion of the rail at the weld portion and track deterioration.

Further, it has been proposed to perform slow cooling after the welding operation, or post heat treatment at the welded portion and the like in order to prevent or diminish the above-mentioned growth of martensite, however, said treatment significantly decreases the welding efficiency and thus is hardly practical.

Moreover, two other processes have been used in many cases for rail welding and these involve the flash-butt welding process and the gas pressure welding process, in which no fusion welding is performed, so that the alloy elements are apt to be oxidized on the weld line. Sufficient joint strength could not be obtained thereby, resulting in problems such as breakage during transportation etc.

Next will be considered heat treated or head hardened rails. A convention example of said rail is disclosed in Fernand J. Dewez, Jr., et al, U.S. Pat. No. 3,124,492 entitled "METHOD FOR HEAT-TREATING RAILS." According to said patent, the head portion of the rail is heated at an austenite transformation temperature up to the maximum depth of 1.5" (38.1 mm), preferably to the depth between ¼" and 1" (6.4 and 25.4 mm), and then the head portion of said rail thus heated is forcibly cooled by air blasting to effect pearlite transformation. Subsequently, the heat retained in the inner part of the rail is conducted to the surface thereof, thereby raising the surface temperature of the rail to 1250° F. (677° C.) for effecting self tempering, and in the next step, the rail is water cooled to ambient temperature. Thereby, the head portion of the rail is hardened on the surface layer thereof and exhibits tensile strength, with the aid of the foregoing tempering process, which is the so-called slack quenching-tempering, and the tensile strength thus obtained is more than about 120 kg/mm$^2$.

Said process seeks to provide a pearlite structure in the heat treated region as shown in FIG. 4. When the rails produced by such slack quenching method are welded, they are subjected to cooling conditions which are remarkably different from their heat treatment. In particular, the cooling rate after welding is considerably slower than the cooling rate during the heat treatment; thereby it is impossible to avoid softening at the welded portion. Thus, the local deformation or abrasion of rails at the softened portion as well as the deterioration in the railroad bed originating from the above-mentioned defects are serious problems.

Further, Heller, U.S. Pat. No. 4,082,577 discloses a heat treatment to produce a pearlite structure by the following steps: heating to an austenite state, and commencing quenching from a temperature between 800° to 850° C. down to 100° C. with boiling water. However, in this instance, notable deformation in rail, that is, bending of rail takes place, so that it is necessary to reform the configuration of rail after heat treatment.

Further, there is disclosed in Japanese Patent Publication Gazette Sho. 47(1972)-32, 168, column 2 lines 24 to 30, heat treatment of a rail for the purpose of increasing depth of the hardened layer at the head portion thereof in order to enhance the abrasion resistant property thereof. In such process, the head portion of said rail is heated to between 860° and 1100° C., then is cooled down slowly to 820° to 850° C. by ambient cooling, is subjected to a quenching treatment, subsequently is heated again up to the temperature of 400° C. to 600° C., and is subjected to tempering treatment. The thus treated portion of said rail can have a hardened layer, thereon with a thickness about twice as deep as that on conventionally heat treated rails. However, this process merely embodies a conventionally effected hardening and tempering treatment.

As a result of the foregoing conventional heat treatment, the microstructure thus obtained becomes tempered "sorbite," which is an obsolete term for tempered martensite, as disclosed in the METALS HANDBOOK (ASM), 8th Edition, vol. 1, "Properties and Selection of Metals," published in 1961 by AMERICAN SOCIETY FOR METALS, Chapter; DEFINITION RELATING TO METALS AND METALWORKING, Sorbite page 35; $Ar_1$; page 39. Further, in said process, rail head portion is heated to 850°–1100° C. for coarsening the crystal grain of austenite structure, however, such procedure as set forth above is neither an attempt at controlling the growth of austenized grains nor at minimizing the pearlite block size. Therefore, when the rail thus quenched and tempered is subjected to welding, it inevitably causes deterioration in properties such as hardness of the above rail at the weld heat affected zone thereof.

As explained hereinbefore, existing high strength rails are certainly provided with base materials (that is, the nonwelded portion) having high strength characteristics and excellent properties but are thoroughly lacking in the ability to prevent the welded portion of rails from deteriorating in strength as well as structure and the like. Therefore, the welded portions of high strength rails tend to exhibit problematic conditions such as hardening, embrittlement or softening with respect to the base material portion.

In sum, many serious welding problems have been encountered in the above-metioned methods for producing high strength rails, i.e. in as-rolled alloy steel rails where alloy elements are employed on the basis of the cooling rates under ambient conditions after hot rolling and in heat treated carbon steel rails where the cooling rate in the heat treatment step is selected on the basis of the ingredients contained in the existing high carbon steels.

SUMMARY OF THE INVENTION

It is an object of the present invention to provide high strength rail of excellent weldability in order to overcome defects of conventional high strength rails, by a process comprising the steps of employing selected alloy elements to increase the strength of high carbon steel as well as to prevent the welded portion from deterioration, subjecting the head portion of the rail, which is the most important part thereof, to heat treatment and making the cooling rate equivalent to the cooling rate in the welding of rails, so as to obtain excellent weldability, that is, to effect welding with high efficiency. Further, it is an object to attain good properties at the welded portion, whose properties are almost the same as that of the base metal, even if left in the as-welded state. In other words, the present invention provides a method for manufacturing high strength rail with excellent weldability which comprises steps of hot rolling a steel into a rail, said steel containing 0.65 to 0.85% of C, 0.50 to 1.20% of Si, 0.50 to 1.50% of Mn, 0.005 to 0.05% of Al, 0.004 to 0.050% of one or both of Nb and Ti, and the balance being iron and unavoidable impurities, then cooling said hot rolled rail to the temperature less than the point $Ar_1$ to have said cooled rail complete the cooling transformation, subsequently reheating the surface layer portion of the head of said transformed rail to 850° C. or more for forming an austenite structure, quenching said reheated head portion of the rail by blast cooling with gas from 800° C. to 600° C. in from 15 to 250 seconds, subsequently gradually cooling down said rail thus quenched from 600° C. to 450° C. in from 30 to 1000 seconds with gas so as to effect pearlite transformation thereof and quenching by blast cooling or air-cooling said rail thus transformed with gas and/or liquid to a temperature below 450° C. for transforming into a fine pearlite structure at the surface layer on the head portion (The term $Ar_1$ means the temperature at which transformation of austenite to ferrite or to ferrite plus cementite is completed during cooling.). Preferably, the fine pearlite has a depth of up to 10 mm from the surface of the head portion as shown in FIG. 5(*a*) and FIG. 5(*b*) respectively, the tensile strength at room temperature is not less than 120 kg/mm$^2$ and the surface hardness at the top plane on the head portion of the rail is more than $H_V$ 350.

A further object of the present invention involves modification of the foregoing process wherein the above-mentioned chemical composition is further admixed with 0.20 to 0.90% of Cr for replenishment, and said steel containing 1.60% or less of Mn plus Cr. The modification set forth hereinbefore involves a method for manufacturing a heat treated low alloy steel rail having hardened head portion thereof and having excellent weldability, said method comprising the step of transforming the steel structure at the surface layer of the head portion thereof, preferably to the depth of 10 mm from the surface of the head portion, into fine pearlite structure whereby the tensile strength of the surface layer is not less than 120 kg/mm$^2$ and the surface hardness at the top plane on the head portion of the rail is more than $H_V$ 350.

BRIEF DESCRIPTION OF THE DRAWINGS

FIG. 2 and FIG. 3 are photographs showing structures of conventional rail steel, of which FIG. 2 shows rail steel having ferrite and pearlite structure containing 0.45% of C. (etchant: 5% nital) and the white area in the photograph represents ferrite structure, while the dark area designates pearlite structure, thus the lamellar structure can be observed, and FIG. 3 shows the rail steel of full pearlite structure (nital etchant) wherein dark area designates the pearlite structure.

FIG. 4–FIG. 5(*b*) are photographs showing the structure of rail steel according to the present invention, of which FIG. 4 shows the pearlite structure (nital etchant) of an ordinary carbon rail according to the method disclosed in U.S. Pat. No. 3,124,492 and the lamellar structure consists of ferrite and cementite, in which each spacing formed between laminated cementites is referred to as an interlamellar spacing, said spacing being about 0.3$\mu$, while FIG. 5(*a*) and FIG. 5(*b*) respectively show very fine pearlite structure (nital etchant) of a steel A at the hardened zone according to the present invention, said very fine pearlite structure being much finer than ordinary pearlite shown in FIG. 4 wherein the interlamellar spacing is about 0.1$\mu$.

FIG. 5(*a*) is a photograph at 5,000× magnification showing the nital etching of the present inventive steel A, while FIG. 5(*b*) is a photograph of 20,700× magnification showing the nital etching of the above same.

FIG. 6(*b*) is an explanatory diagram with respect to FIG. 6(*a*); in said FIG. 6(*b*):

Figure 1A:
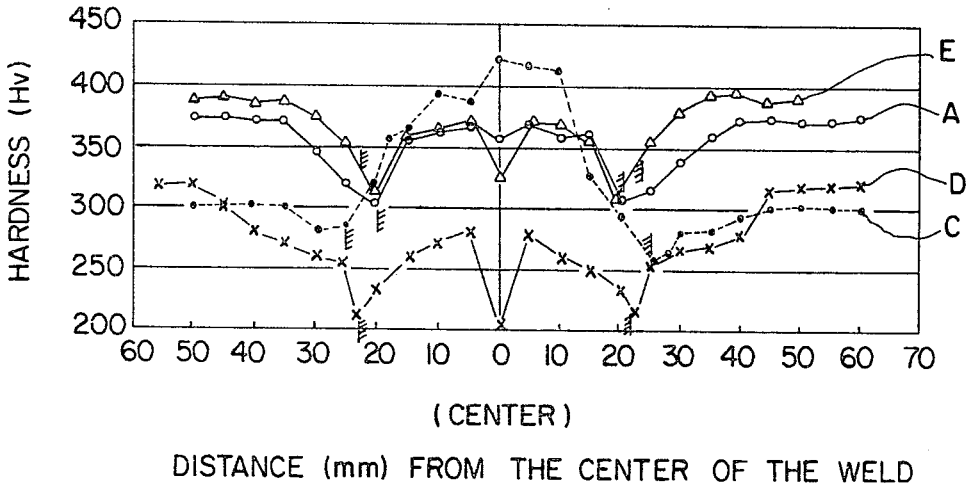
FIG. 1(*a*) and FIG. 1(*b*) are respectively, diagrams showing the variation in hardness of the welded portion formed by flash butt welding at various distances from the center of said flash butt weld portion with respect to rails according to both the present invention and other conventional prior art, wherein hardness is measured at a point 5 mm below the top plane on the head portion, within the central cross sectional surface.

Zone (I), or the black peripheral area represents the zone which is forcably quench-hardened after heating to temperatures above 850° C., Zone (II), or the white area adjacent to zone (I) represents the heat-affected zone where cooling is comparatively slow after heating above the transormation temperature, Zone (III) represents the portion of the base metal which is unaffected by heat treatment.

DESCRIPTION OF THE PREFERRED EMBODIMENTS

For manufacturing a high strength rail having excellent weldability according to the present invention, a low alloy high carbon steel containing any one of the following two kinds of compositions, which are molten and produced in a converter or an electric furnace, are rolled into a rail.

First, a low alloy, high carbon steel containing 0.65 to 0.85% of C, 0.50 to 1.20% of Si, 0.50 to 1.50% of Mn, 0.005 to 0.050% of Al, and 0.004 to 0.050% of one or both of Nb and Ti is rolled into a rail.

Among the above-enumerated chemical ingredients, carbon is a necessary element for increasing strength as well as for enhancing abrasion resistance, however, in the case of the carbon content being less than 0.65%, low carbon bainite is grown in the course of heat treatment. Thus said abrasion resistance is deteriorated. When the carbon content is in excess of 0.85%, proeutectoid cementite is produced at the austenite grain boundary or martensite is generated at a micro-segregation portion, in other words at the grains in which carbon is segregated positively, in the heat treated layer and the welded portion to give rise to hardening as well as embrittlement. Thus, the carbon content is employed in the range between 0.65 and 0.85%. The preferable content of carbon ranges from 0.7 to 0.8% in view of increasing strength as well as of preventing the deterioration of rail quality caused by welding.

Silicon is favorable for increasing the strength by reinforcing ferrite, even in pearlite steel, as well as for enhancing shelling resistance, and further, has little influence on starting time and temperature of pearlite transformation. Thereby, control of the cooling rate can be facilitated, taking the heat treatment and welding operation into consideration, however, in case of the silicon content being less than 0.50%, it is hard to obtain a full measure of the above-mentioned effects, while in case of the silicon content being the excess of 1.20%, embrittlement as well as deterioration in welded joint strength occurs. In consequence, silicon is employed in the range between 0.5 and 1.20%. The preferred silicon content is within the range of 0.7 and 1.0%.

Manganese is an element for delaying pearlite transformation, which permits control of the start of pearlite transformation as well as control of the strength by varying its content, however, when the manganese content is less than 0.50%, it is hard to realize the above-mentioned advantage, while in case of being in excess of 1.50%, hydrogen embrittlement is likely to occur and martensite may be produced due to segregation, in other words, because of carbon being segregated positively. Therefore, the manganese content is limited to the range of from 0.50 to 1.50%. The desirable manganese content ranges between 1.0 and 1.4%, in view of practical control of the pearlite transformation.

Addition of niobium and titanium involves one of the characteristics of the present invention, and also one of the effects thereof is to protect the rail face from scarring (that is, surface defects), and said elements are extremely effective for enhancing shelling resistance. Moreover, another effect is to greatly shorten the time necessary for completing pearlite transformation and is thus effective for preventing formation of undesirable martensite in the course of heat treatment or cooling treatment during welding operation. Further, in case of the present inventive rail being welded at the strengthened portion with the aid of heat treatment, changes in the surface hardness are effectively diminished in the extreme, provided that the cooling period is within the range defined by the present invention.

Furthermore, another effect resides in restraining growth of austenite grain during heating at the temperature within the austenite range, so as to improve the ductility. These effects set forth above are based on the presence of fine carbide which is precipitated during heat treatment for base metal of the present inventive rail steel, and these effects can be obtained by adding either niobium or titanium alone or together. However, if the total content of one or both Nb or Ti is less than 0.004%, said effects can not be attained, while in case of being in excess of 0.050%, extremely coarse carbonitrides are grown, thereby decreasing the ductility as well as fatigue strength. Thereby the Nb and Ti contents are in the range between 0.004 and 0.050%. The desirable Nb and Ti contents are limited to Nb being 0.004 to 0.02%, while Ti is 0.004 to 0.015%, in order to obtain good shelling resistance and fine pearlite structure and to prevent fluctuation in strength and composition upon welding.

Aluminum is added for deoxidation and is effective for homogenizing the quality of steel as well as for preventing the growth of silicate inclusions which decrease fatigue strength; however, where the aluminum content is less than 0.005%, the foregoing effects cannot be obtained, and where it is in excess of 0.050%, the embrittling effects become active; thereby the aluminum content is in the range of 0.005 to 0.050%, and the preferred aluminum content ranges from 0.005 to 0.015%.

Further, the reason for adding Cr and reason for limiting the content thereof are as follows. If Mn is not used together with Cr and Nb, the micro-segregation of Mn becomes stronger as the sectional area of steel ingot or the rail becomes enlarged. Thus, fine martensite is produced at the hardened layer of rail head portion in the course of heat treatment or at the weld heat affected zone during welding, resulting in the occurrence of an embrittling effect. Therefore, in this instance, the Mn content is decreased and Cr is substituted therefor to compensate for a decrease in the strength resulting from the decrease in Mn content. Furthermore, crystal grains grown in the course of the casting operation as well as the heat treatment are refined with the aid of Nb, which procedure is very fruitful for preventing growth of martensite due to micro-segregation.

Where the Mn content is decreased, substituting Cr for Mn is effective to control the pearlite transformation. This in turn provides the capability of controlling the strength under conditions including freedom from micro-segregation and prevents formation of fine martensite. Where the Cr content is less than 0.20%, the foregoing effect can not be fully obtained, while in case of being in excess of 0.90%, the weld joint strength is deteriorated during the welding operation. Consequently, the Cr content is between 0.20 and 0.90%. In this instance, since the Mn content is decreased, the Mn content is limited to the value between 0.50% to 1.40%. Furthermore, in case of the total amount of Mn+Cr content being in excess of 1.60%, fine martensite is grown at the welded portion even though said Mn content has been lowered. Thus, the upper limit of the total amount of Mn+Cr is 1.60% or less. In case of Mn and Cr being added together, it is much more effective to use Nb with the foregoing elements.

As elucidated hereinbefore, a decrease in Mn content and addition of Cr together with Nb are effective where the sectional area of the steel ingot or the sectional area of the rails is enlarged. Where the sectional area of the steel ingot is made smaller or continuous casting is employed, in which case the slab is quenched by blast cooling, Cr and Nb need not be added. Thus the aforementioned limit for the contents of Cr and Nb are non-critical features of the present invention.

Next, the following heat treatment for two kinds of rails obtained through the rolling of the present inventive steel into rails have been carried out respectively.

First, both kinds of rails are subjected to induction heating or flame heating, preferably to induction heating with AC power having a frequency of less than 2.5 KHz so as to obtain an austenite structure in order to considerably strengthen the rail at the surface layer on the head portion thereof, preferably to the depth of at least 10 mm from the top plane on the head portion of the rail. However, the heating temperature homogeneously transforms said heated surface layer of the desired depth into an austenite structure. Thus said surface layer should be heated at the temperature of higher than 850° C. which is higher than $AC_3$ transformation point.

The frequency mentioned above is varied due to the depth of surface hardened layer, but it is desirable to employ a frequency of AC power of less than 3.0 KHz in order to obtain the depth of the hardened layer of at least 10 mm.

Moreover, in quenching by blast cooling after heat treatment, the cooling rate of said quenching is set, based upon the temperature range and the cooling period, at a value equivalent to the cooling rate in the welding operation wherein said surface layer of the rail head portion is quenched by blast cooling from 800° C. to 600° C. in from 15 to 250 seconds with gas, and is gradually cooled down from 600° C. to 450° C. in from 30 to 1000 seconds with the aid of gas. Subsequently, the rail is quenched by gas and/or liquid to a temperature below 450° C.

The foregoing ranges of temperature and time are selected to be equivalent to the cooling conditions in the welding of rails. Further, the above-mentioned period of time can properly be selected dependent upon the size of rails and the content of alloy elements.

In the case where the cooling time is less than 15 seconds from 800° C. to 600° C., the martensite structure is produced, while in case of said cooling time being in excess of 250 seconds, a rail with a fine pearlite structure and a tensile strength of more than 120 kg/mm$^2$ cannot be obtained. Therefore, the time necessary for cooling the foregoing heated surface layer from 800° C. to 600° C. is between 15 and 250 seconds.

The rail subjected to quenching by blast cooling from 800° C. to 600° C. in from 15 to 250 seconds is gradually cooled without delay to from 600° C. to 450° C. in from 30 to 1000 seconds so as to complete pearlite transformation within said temperature range as well as to prevent recuperation of heat up to the temperature of higher than 600° C. due to the heat of reaction from the pearlite transformation, and successively is quenched by blast cooling or is subjected to an air-cooling treatment to a temperature below 450° C. with the aid of a mixture of gas and liquid.

The reason for subjecting said surface layer of the rail head portion to quenching by blast cooling down to 600° C. in the above-mentioned heat treatment is to prevent occurrence of the pearlite transformation at the temperature above 600° C., while the reason for adjusting the temperature range in the gradual cooling treatment from 600° C. to 450° C. is that if the temperature rises higher than 600° C., the interlamellar spacings in the pearlite structure become coarse and it is not possible to obtain a strength of 120 kg/mm$^2$, while in case of the temperature being lowered to below 450° C., the bainite structure is produced. Thereby the abrasion resistance as well as the shelling resistance are deteriorated because the bainite structure is different from the pearlite structure even though the strength of the rail is made higher. Moreover, the reason for effecting the gradual cooling treatment from 600° C. to 450° C. in from 30 to 1000 seconds with the aid of gas lies in the fact that the pearlite transformation can be completed and the pearlite structure becomes fine within the above-mentioned period of time. According to the present method, the chemical composition of rail steel is adjusted to permit the pearlite transformation within the foregoing period of time for gradually cooling down from 600° C. to 450° C. after said rolled rail has been welded. On the other hand, when the gradual cooling treatment is performed in less than 30 seconds, martensite is produced, and when said period of time is in excess of 1000 seconds, the above-mentioned advantageous effects will not be attained even though a comparatively long period of time is employed for the gradual cooling treatment.

The reason for utilizing the cooling treatment at the temperature below 450° C., that is, quenching by blast cooling or air-cooling with the aid of mixture of gas and liquid is because of the fact that if the heated portion of the rail is kept at a high temperature after the pearlite structure has been produced, the cementite within the pearlite structure is spheroidized to deteriorate the strength of the rail as well as to degrade the abrasion resistance and the shelling resistance thereof respectively, while in case of the cooling rate being high, the residual stress at the surface layer on the rail head portion is converted into compressive stress so as to enhance the fatigue strength. Therefore, it may be preferable to cool down the heated portion of the rail to room temperature as soon as possible.

The cooling conditions mentioned hereinbefore refer to the cooling conditions at the weld portion and in consequence, the mechanical properties of the base metal are similar to that of the welded portion, which in turn is in consequence of obtaining a fine pearlite structure.

On the other hand, if a rail produced from a steel having a chemical composition identical to that of the present inventive steel is quenched by blast cooling to the temperature below 450° C., for instance, between 100° and 200° C., even though the steel contains alloying elements and even though said rail is dipped in boiling water for the foregoing quenching treatment, martensite is produced to render said rail thus quenched worthless for practical use.

Further, where the pearlite transformation has occurred in the course of forced cooling treatment, the deformation of rail is excessive and this may not be corrected in later stages. However, in the case of said forced cooling treatment being discontinued as is done in the present method to produce the pearlite transformation during the slow-cooling treatment, which in turn prevents deformation of the rail, the present invention has the great advantages of permitting reformation of the deformed rail in a softened condition prior to the heat treatment as well as avoidance of troublesome reformation after the heat treatment.

Moreover, in the course of cooling at a temperature below 500° C., a very fine pearlite structure can be attained with a water-cooling treatment at the rail head portion in just the same manner as where said rail head portion is subjected to the air-cooling treatment, however, in the foregoing water-cooling treatment, it does not suffer from deterioration in the profile or configuration of the rail. Further, it has clearly been understood that the distribution of residual stress favorably acts to maintain the abrasion resistance as well as the shelling resistance as compared with the air-cooling treatment. An extremely fine pearlite structure having less than about 0.15 μm and preferably not more than 0.13 μm of interlammellar spacing of pearlite is produced with the aid of a series of the above-mentioned heat treatments.

Next, after investigating the influence of the interlamellar spacing of pearlite on the properties of the steel the following facts are noted:

(1) Said interlammelar spacing of pearlite affects the strength of the rail, and when said interlamellar spacing of pearlite is represented by the symbol d, the strength is increased in proportion to the value expressed by $1/\sqrt{d}$. Therefore, the finer the interlamellar spacing d, the higher the strength of the rail.

(2) The smaller the interlamellar spacing d, the higher becomes the abrasion resistant property of the rail.

(3) When the interlamellar spacing d is large, the reduction of area (ϕ) is large. The fact that the reduction of area (100) is large means that the rail has large deformability until the surface fractures. Thus the present inventive rail exhibits excellent shelling resistance and durability.

In view of the aforementioned facts, the present inventive rail exhibits excellent properties such as high strength, wear resistance, shelling resistance and durability, due to said rail having less than 0.15 μm of fine interlamellar spacing d of pearlite.

The cooling time from 800° C. to 600° C. is rather short as compared with the cooling time of about 800 seconds which is employed in the cooling treatment of a rail of 60 kg in an ambient cooling system, and is necessary for some forced cooling means to be employed. Such forced cooling means are, for example, spraying a gas, e.g. air, inert gas and the like or mixture containing gas and a small quantity of liquid through a nozzle, however, it is rather difficult to control the cooling time with only a liquid. Therefore, the present method effects quenching by blast cooling with the aid of the foregoing gases. During or after the abovementioned cooling treatment, the rail surface temperature of the treated rail will hardly rise due to recalescence. The structure formed upon cooling is the fine pearlite structure and in a high strength steel having the tensile strength more than 120 kg/mm$^2$, said fine parlite structure is much superior to martensite, low carbon bainite and tempered martensite structures respectively in respect of abrasion resistance and shelling resistance. Therefore, said fine pearlite structure is indispensable for the present inventive rail. The strength of surface layer reinforced by the heat treatment is more than 120 kg/mm$^2$, thus providing a rail with higher strength than that of existing high strength rail.

In order to facilitate the evaluation of strength, it is possible to define the strength of the rail head portion with reference to the hardness at the top surface on the rail head portion. To this end, the hardness of the top surface on the rail head portion is set at not less than $H_V$ 350. Still further, the depth of the reinforced layer of the rail head portion is 10 mm from the upper side and the flank of the head portion, and the tensile strength is more than 120 kg/mm$^2$ respectively. However, it is inadvisable to obtain a reinforced layer having the depth of more than 10 mm, or to strengthen the entire cross-sectional area of the rail, because of the fact that the abrasion and shelling on the high strength rail only occur on the surface of the head portion of said rail and manufacturing of said rail becomes very difficult. The web and the flange portions of the present inventive rail are free from the heat treatment and are kept in the as-rolled state, but the tensile strength at the foregoing portion is about 100 kg/mm$^2$ and then is sufficient for practical use. Due to the above reason, the present inventive rail does not suffer from any deterioration in quality of base metal even at the melt portion of the rail caused by weld heat influence so as to attain a strength and structure equivalent to that of the base metal.

The explanation of the present invention will now be given with reference to the drawings by way of example in a form of embodiment of the invention.

EXAMPLE 1

Table 1 shows the chemical compositions and the tensile properties at the strengthened layer on the head portion of base metal rails according to the present invention and comparative conventional steels.

In the heat treatment for the present inventive steels A and B, the cooling period of time elapsing from 800° C. to 600° C. is 70 seconds for steel A and 45 seconds for steel B, subsequently the cooling time from 600° C. to 450° C. is 560 seconds for steel A and 700 seconds for steel B. In a further cooling treatment in a subsequent stage, the rail A is subjected to air-cooling while rail B is subjected to water-spray cooling. Conventional steel C is an as-rolled Si-Cr type alloy steel rail having a fine pearlite structure, while conventional steel D is a heat treated carbon steel rail, and said carbon steel rail D was heated at the head portion thereof by induction heating, then was quenched and tempered so as to form a tempered martensite structure (sorbite structure).

Table 1—The chemical compositions and the tensile properties of base metal rails in the present inventive steels and comparative conventional steels.

TABLE 1

| | | present inventive steel | | conventional steel | |
|---|---|---|---|---|---|
| | | A | B | C | D |
| chemical composition (%) | C | 0.75 | 0.72 | 0.55 | 0.66 |
| | Si | 0.75 | 0.93 | 0.75 | 0.22 |
| | Mn | 1.21 | 1.40 | 1.49 | 0.88 |
| | P | 0.017 | 0.017 | 0.024 | 0.012 |
| | S | 0.011 | 0.008 | 0.016 | 0.018 |
| | Nb | 0.019 | | | |
| | Ti | | 0.012 | 0.007 | 0.013 |
| | Al | 0.021 | 0.015 | 0.017 | 0.012 |
| | Cr | | | 1.08 | |
| tensile property of strengthened layer | yield point ($\sigma_{0.2}$) (kg/mm$^2$) | 88.0 | 86.0 | 64.8 | 92.6 |
| | ultimate strength ($\sigma_B$) (kg/mm$^2$) | 130.0 | 126.3 | 101.9 | 118.3 |
| | elongation ($\delta$) (%) | 14.0 | 14.3 | 17.9 | 21.2 |
| | reduction of area ($\phi$) (%) | 44.4 | 41.2 | 41.2 | 55.5 |
| rail size (kg/m) | | 60 | 60 | 60 | 60 |

The rails A and B according to the present invention have tensile strengths ($\sigma$B) of larger than 120 kg/mm$^2$ and underwent reduction of area ($\phi$) of more than 40%; thus both of said rails have excellent ductility as well as sufficiently high strength respectively.

As compared with said present inventive rails A and B, comparative conventional rail C contained slightly smaller amounts of carbon, nearly the same amount of silicon and manganese, and large amounts e.g. 1.08% of chromium, however, the tensile strength of the rail C is fairly low i.e. only 120 kg/mm$^2$, and the reduction of area is similar to that of said rails A and B. Said conventional steel D, despite the fact that it contains a low amount of alloy components, has a tensile strength of 118 kg/mm$^2$ which is equivalent to that of the present inventive steels. Moreover, said steel D has a higher yield ratio which results from the heat treatment such as quenching and tempering.

Figure 1B:
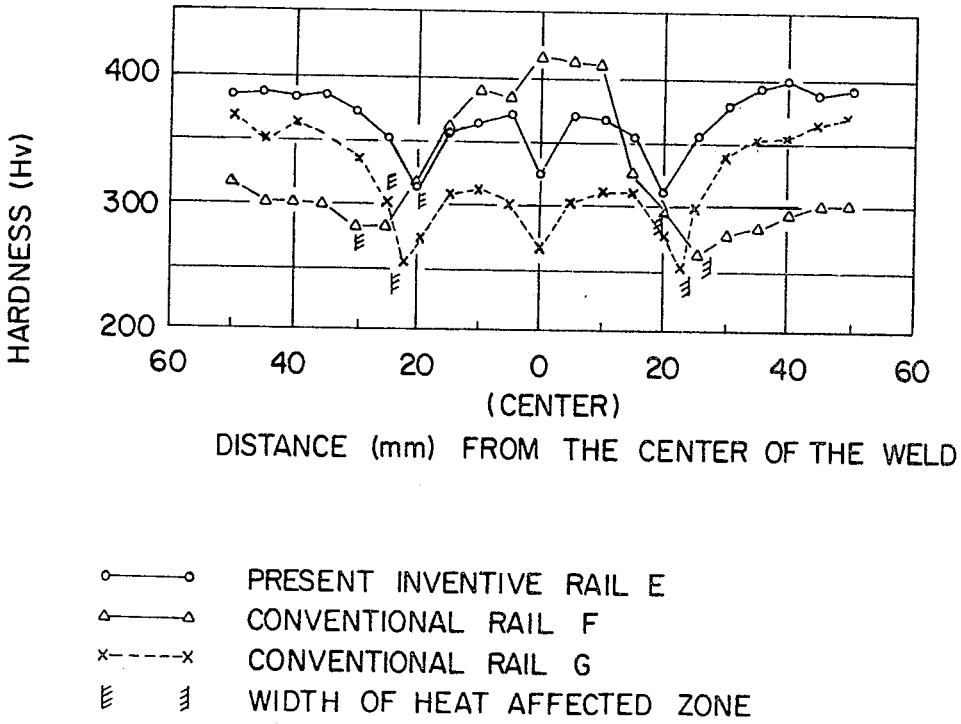
Figure 6B:
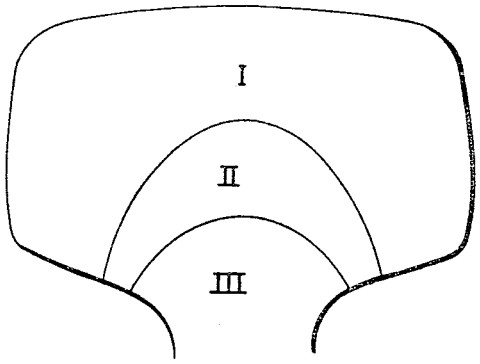
FIG. 6(*a*) shows a microstructure of the transverse section of the rail head portion after heat treatment according to the present invention.
Figure 2:
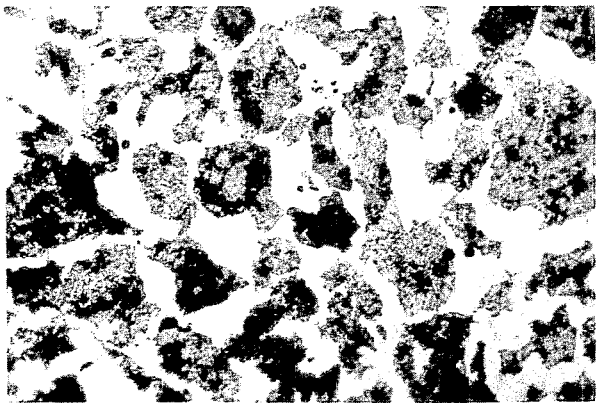
Figure 3:
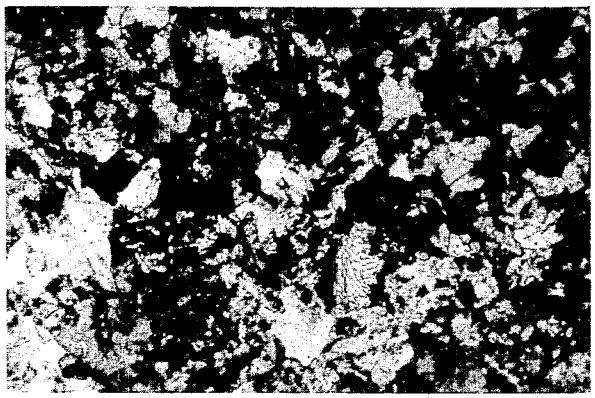
Figure 4:
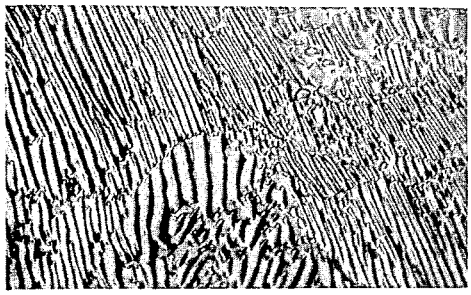
Figure 5A:
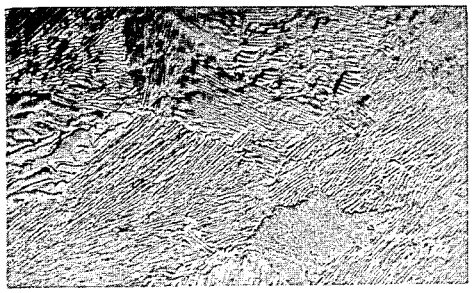
Figure 5B:
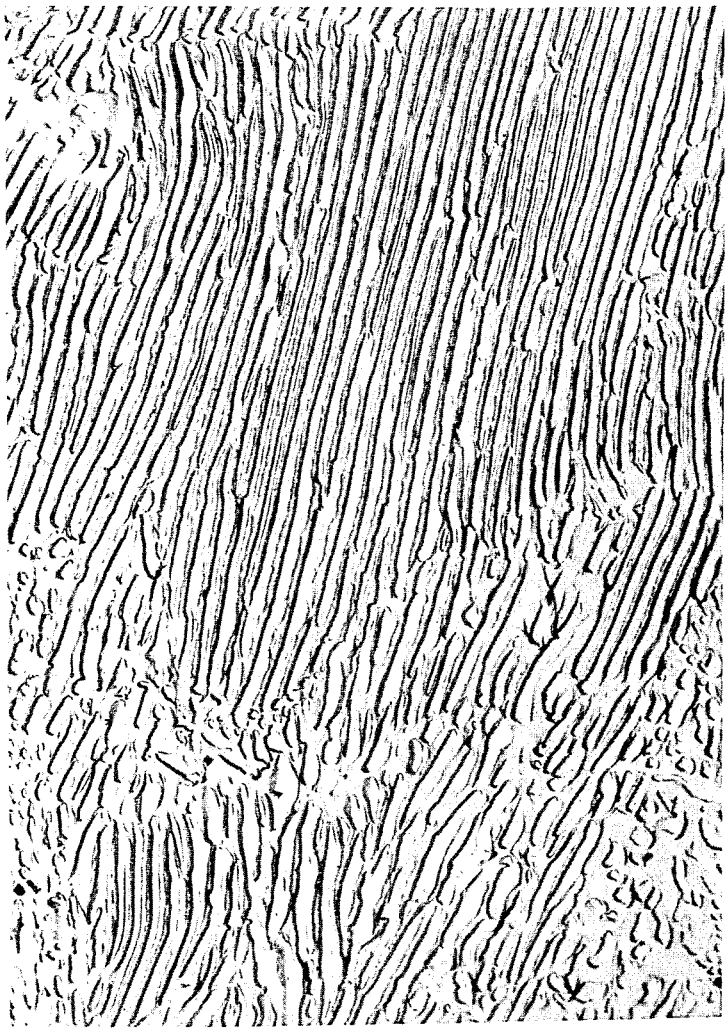
Figure 6A:
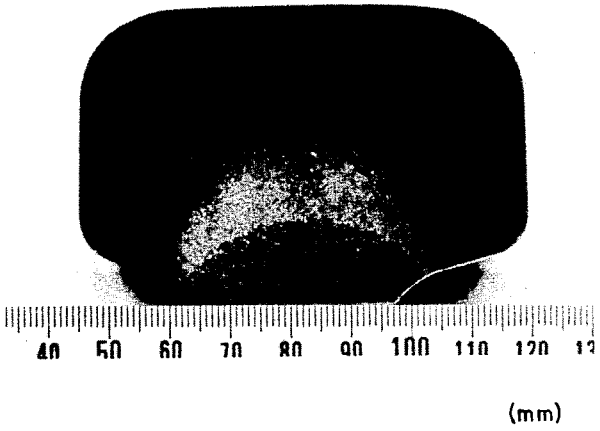

FIG. 1 shows the variation in the hardness at the flash-butt welded portion of the steels A, C and D, however, in the present inventive steel A, softened portions are observed at about 20 mm on each side of the center of the welded portion respectively. However, the range and extent of the softened portion are small respectively, while the hardness near the center of the welded portion is about $H_V$ 360. This is not very different from the hardness of the base metal rail at the left and the right sides of the foregoing center, which is about $H_V$370, said symbol $H_V$being used to measure the hardness on the sectional surface of the product or the welded portion. The structure of the welded portion is also transformed into a fine pearlite structure through successive cooling treatments, so that the present inventive steel exhibit very little variation in the quality of metal at the welded portion. On the other hand, the hardness of the base metal is about $H_V$300 in the comparative conventional steel C, while the welded portion of said steel C is hardened to an excess of $H_V$ 400, whereby martensite is observed as being scattered throughout the structure, which proves that the metal has been hardened and embrittled. If such hardened and embrittled rail is used as is, serious troubles such as premature failure of the rail at the welded portion thereof or deterioration of track occurs. In order to eliminate the above-mentioned hardening and embrittlement, it is necessary to carry out a treatment after welding such as a gradual cooling or a post heat tempering and the like. Said treatments remarkably degrade the welding efficiency or the welded joint strength is deteriorated because of excessive Cr content, thus resulting in difficulty in selecting appropriate welding conditions.

On the other hand, the comparative conventional steel D has a hardness at the base metal portion of $H_V$ 320, while the hardness at the welded portion is less than $H_V$300, which corresponds to the hardness of the base metal portion prior to heat treatment. Furthermore, the extent of softening approaches 100 mm and thus, the heat treatment becomes completely ineffective at weld zone. The foregoing ineffective treatment results from the fact that the cooling rate at the weld of the rail is extremely slow as compared with the cooling rate in the heat treatment. Therefore, local abrasion as well as deformation of the rail occurs, resulting in serious deterioration of the track.

EXAMPLE 2

Table 2 shows the chemical compositions and the tensile properties of the hardened layer on the head portion of base metal rails according to the present invention and comparative conventional steels. The cooling time from 800° C. to 600° C. in the heat treatment for the present inventive steel E is 140 seconds while the cooling time from 600° C. to 450° C. is 740 seconds for said rail E, however, at the temperature below 450° C., said steel E is cooled by a water-spraying process.

Comparative steel F is a conventional as-rolled Si-Cr type alloy steel rail with a fine pearlite structure, while a comparative conventional steel G is a heat treated carbon steel rail with a hardened head portion thereof in which said carbon steel rail is heated at the head portion thereof by the induction heating process, subsequently is subjected to slack quenching treatment, and said steel G also has a fine pearlite structure as does steel F.

Table 2 The chemical compositions and the tensile properties of the steel rails of the present invention and comparative conventional steel rails.

TABLE 2

| | | present inventive steel | conventional steel | |
|---|---|---|---|---|
| | | E | F | G |
| chemical composition (%) | C | 0.78 | 0.55 | 0.74 |
| | Si | 0.89 | 0.75 | 0.22 |
| | Mn | 0.81 | 1.49 | 0.93 |
| | P | 0.021 | 0.024 | 0.028 |
| | S | 0.005 | 0.016 | 0.014 |
| | Al | 0.009 | 0.017 | 0.015 |
| | Cr | 0.59 | 1.08 | — |
| | Nb | 0.008 | — | — |
| tensile property | $\sigma_{0.2}$ (kg/mm$^2$) | 97.6 | 64.8 | 82.2 |
| | $\sigma_B$ (kg/mm$^2$) | 136.6 | 101.9 | 122.8 |
| | $\delta$ (%) | 21.4 | 17.9 | 16.7 |
| | $\phi$ (%) | 57.6 | 41.2 | 41.0 |
| rail size (kg/m) | | 68 | 60 | 68 |

The present inventive rail E has a tensile strength of more than 120 kg/mm$^2$ as well as a reduction of area ($\phi$) of more than 40%. In addition, it has excellent ductility despite high strength.

The above-mentioned conventional steel F contains a slightly smaller amount of carbon as compared with that of the present inventive steel, but the silicon and manganese content is equivalent to that of said steel A. Moreover, the 1.08% chromium content appears to be slightly higher than that of said steel A but the tensile strength is rather low, i.e. 102 kg/mm$^2$, and the reduction of area is equal to that of steel E. Moreover, the comparative conventional steel G has a tensile strength of 123 kg/mm$^2$ which is equivalent to that of the present inventive steels despite the alloy content being slightly lower than that of said steels, while said steel G has a high yield ratio which results from the so-called slack quenching treatment.

FIG. 1, in which the hardness is measured on the longitudinal sectional area in the central portion at a point from the upper side plane of the head portion, shows the variation of hardness at the flash-butt welded portions of the foregoing rails. However, even though a softened portion has been observed at a point about 20 mm from the center of the welded portion of the present inventive steel E, the range and the extent of the softening are not noticeable, and the hardness in the neighborhood of the central welded portion is about $H_V$ 350 which is not very different from the hardness of the base metal rail on both sides of said central welded portion, i.e. about $H_V$ 370. Thereby the structure of the welded portion is observed to be transformed to a fine pearlite structure due to successive cooling during welding, which proves that the present inventive steel exhibits almost no variation in the properties of the welded portion. On the other hand, the comparative conventional steel F has a hardness of the base metal about $H_V$ 300 while the hardness at the welded portion is in excess of $H_V$ 400. Thereby martensite is scattered throughout the structure which proves to be extremely hardened and embrittled. Thus, if said steel F is used as is, premature failure of rail at the welded portion thereof, or deterioraton of track may occur. In order to eliminate the foregoing hardening and embrittlement defects, treatment such as gradually cooling down after welding or post heat tempering and the like have to be performed. Said treatments, however, degrade the welding efficiency and in addition, the welded joint strength is deteriorated due to excessive chromium content, thus making it difficult to select appropriate welding conditions. On the other hand, the comparative conventional steel G has a hardness at the base metal portion there of about $H_V$350, while at the welded portion, the hardness is lower than $H_V$ 310 and it should be softened to the hardness of the base metal prior to the heat treatment. The extent of such softening is very extensive, i.e. about 70 mm which proves that the heat treatment is entirely ineffective at weld zone. This results from the fact that the cooling rate in the heat treatment is much higher than the cooling rate at the welded portion. Consequently, local abrasion as well as deformation of the rail occur at the foregoing softened portion.

As elucidated hereinbefore, the present invention has defined the chemical composition of steel and the conditions of the heat treatment with a view towards greatly strengthening the rail and preventing deterioration of properties of the base metal due to welding. Thus, the rail manufactured according to the present inventive method has the tensile properties of the base metal, which is not much different from that of an existing high strength rail. Moreover, the properties of the welded portion vary little and are equivalent to those of the base metal. Such properties contribute to the excellent characteristics of the present inventive rails. Thus, the instant rails are comparatively free from defects such as hardening, embrittlement or softening at the welded portion, which defects are encountered in conventional steel rails.

What is claimed is:

1. A high strength steel rail of excellent weldability, said steel containing 0.65 to 0.85% of C, 0.50 to 1.20% of Si, 0.50 to 1.50% of Mn, 0.005 to 0.050% of Al, 0.004 to 0.050% of one or both of Nb and Ti, and the balance being iron and unavoidable impurities and said rail having a surface layer on the head thereof to a depth of 10 mm or more, said surface layer having a fine pearlite structure with a tensile strength or more than 120 kg/mm$^2$, a reduction of area of more than 40% and a surface hardness at the surface layer of $H_V$350 or more, the weldability of said rail being such that when said rail head is welded, the welded portion has properties which are almost the same as those of the non-welded portion.

2. The rail of claim 1 produced by a process comprising the steps of:

a. hot rolling steel into a rail, said steel containing 0.65 to 0.85% of C, 0.50 to 1.20% of Si, 0.50 to 1.50% of Mn, 0.005 to 0.050% of Al, 0.004 to 0.050% of one or both of Nb and Ti, and the balance being iron and unavoidable impurities, b. cooling the hot rolled rail to a temperature less than the point $Ar_1$ to cause the cooled rail complete cooling transformation, c. reheating the surface layer portion of the head of the transformed rail to a temperature not less than 850° C. to obtain an austenite structure, d. quenching said reheated portion of the rail with a gas from 800° C. to 600° C. in from 15 to 250 seconds, e. gradually cooling down said rail thus quenched from 600° C. to 450° C. in a period of from 30 to 1000 seconds with a gas, during which period pearlite transformation is substantially started and completed, and f. subjecting said rail thus gradually cooled down to a subsequent quenching treatment or a subsequent air-cooling treatment with gas, liquid or combination thereof to below 450° C.

3. The rail of claim 1 wherein said steel further contains 0.20 to 0.90% of Cr and 1.6% or less of Mn+Cr.

4. The rail according to claim 2 wherein said steel further contains 0.20 to 0.90% Cr and 1.6% or less of Mn+Cr.

5. The rail according to any one of claims 1 to 4 wherein the interlamellar spacing between pearlite laminae in said fine pearlite structure formed on said surface layer is less than about 0.15 $\mu$m.

* * * * *

UNITED STATES PATENT AND TRADEMARK OFFICE

CERTIFICATE OF CORRECTION

PATENT NO. : 4,426,236

DATED : January 17, 1984

INVENTOR(S) : KAZUO SUGINO; Kageyama, Hideaki; and Masumoto, Hiroki.

It is certified that error appears in the above-identified patent and that said Letters Patent are hereby corrected as shown below:

IN THE CLAIMS:

CLAIM 1, line 8, change "or" to --of--.

Signed and Sealed this

First Day of May 1984

[SEAL]

*Attest:*

GERALD J. MOSSINGHOFF

*Attesting Officer*

*Commissioner of Patents and Trademarks*